US010357705B1

(12) United States Patent
Hancock et al.

(10) Patent No.: US 10,357,705 B1
(45) Date of Patent: Jul. 23, 2019

(54) LATERALLY STABILIZED BILLIARD CUE TIP

(71) Applicant: Performance Billiards LLC, Mansfield, OH (US)

(72) Inventors: Edward Hancock, Mansfield, OH (US); Adam Martin, Lucas, OH (US)

( * ) Notice: Subject to any disclaimer, the term of this patent is extended or adjusted under 35 U.S.C. 154(b) by 0 days.

(21) Appl. No.: 16/027,349

(22) Filed: Jul. 4, 2018

(51) Int. Cl.
*A63D 15/12* (2006.01)

(52) U.S. Cl.
CPC ..... *A63D 15/12* (2013.01)

(58) Field of Classification Search
CPC ..... A63D 15/12
USPC ..... 473/49, 51
See application file for complete search history.

(56) References Cited

U.S. PATENT DOCUMENTS

| | | | | | |
|---|---|---|---|---|---|
| 693,254 | A * | 2/1902 | Folsom | A63D 15/12 473/49 |
| 1,230,122 | A * | 6/1917 | Connell | A63D 15/12 473/51 |
| 1,677,282 | A * | 7/1928 | Guthrie | A63D 15/12 473/49 |
| 5,016,877 | A | 5/1991 | Lowery | |
| 5,938,536 | A | 8/1999 | Minke | |
| 6,251,024 | B1 | 6/2001 | Summers | |
| 6,840,867 | B1 | 1/2005 | Chang | |
| 7,201,666 | B1 | 4/2007 | Chan | |
| 7,520,817 | B2 | 4/2009 | Sullivan | |
| 7,780,538 | B1 | 8/2010 | Probst | |
| 2017/0173446 | A1 | 6/2017 | Costain | |
| 2018/0085657 | A1 | 3/2018 | Costain | |

* cited by examiner

*Primary Examiner* — Mark S Graham
(74) *Attorney, Agent, or Firm* — Michael J. Gallagher, Esq.; Luper Neidenthal & Logan, LPA

(57) ABSTRACT

The disclosed invention relates an improved laterally reinforced billiard cue tip. One or more lateral reinforcing layers, internal or external to the tip, may be provided to limit lateral expansion of the tip and provide a tip that has the playing characteristics of both hard, and soft, traditional tips, as well as improved shape and playing characteristics.

14 Claims, 10 Drawing Sheets

LATERALLY STABILIZED BILLIARD CUE TIP

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present disclosure relates generally to the field of sports implements for striking an object ball, especially to a laterally reinforced billiard cue tip.

BACKGROUND OF THE INVENTION

The present invention relates in particular to a laterally stabilized billiard cue tip. However, in the largest sense, the game of billiards in all its variations, i.e., billiards, pool, snooker and the like; may be seen as a sub-part of a larger set of sports in which a striking implement is used to direct a ball on a predetermined course. While the skill of the player may be prominent, it is obvious that the nature of the striking implement will have a large effect on the results produced. According, although "billiard cue tip" and various variants are used to describe the invention in the specification and claims herein, the invention is meant to include any sports instrument used for striking an object ball.

In billiards, and as may be seen in the prior art illustration shown as FIG. 1, a billiard cue stick, also sometimes known as a "cue," "stick" "cue stick," and the like is used to strike a first object ("cue") ball, with the force of impact driving the cue ball into a second object ball. The most common billiard cue or sue stick in common use today includes a long, usually wooden shaft (S) tipped with a tip (T). The tip is most commonly made of leather, either a single piece or a composite of multiple layers, but other materials, especially phenolic may be used. Sometimes a ferrule (F) may be placed at the distal end of the billiard cue, often made of metal, serving both a decorative function and helping reinforce the wooden shaft against the sudden impacts produced by the tip striking a ball.

Since the tip is that part of the stick which strikes the cue ball, both the hardness and surface characteristics of the tip are critical, as would be known to one skilled in the art. Tips vary greatly in hardness, including some leather tips, being relatively hard. Other tips are known to be softer. By way of reference, most commonly used billiard cue tips on the market today will display a hardness of 66-96 on the 0-100 (100 being maximum hardness) Shore hardness scale as measured on a standard Shore D Durometer with 1 kilogram of pressure. Players generally believe that a hard tip will impart more force to the struck object ball than a softer tip.

Contemplation of the force vectors involved in the impact of a cue tip on an object ball will reveal that when an axial force is created by striking the object ball with the cue stick, the largest energy vector will be in the axial dimension of the stick. However, there will also be a force vector, due to partial absorption of the force by the material of the tip, oriented sideways, or approximately 90 degree relative to the tip and stick axis. This lateral vector a) results in less force being transmitted to the object ball, and b) in time, sometimes a relatively short time, causing a "mushroom" and deformation of the tip itself. Obviously, these problems are more pronounced the softer the tip material.

Many players generally believe that soft tips will absorb more impact causing the tip to stay on the cue ball for a fraction of a second longer than harder tips. This is believed to result in more cue ball spin, commonly referred to as "English", when the cue ball is struck slightly off center. Softer tips, as would be expected, suffer more from impact and will tend to get misshaped faster and require more maintenance to keep a rounded shape and to fix any mushrooming when the tip bulges out over the side of the ferrule. Because of the additional maintenance, softer tips end up needing to be replaced more frequently.

Hard tips are generally thought not to absorb much force or stay on the cue ball as much at impact as a softer tip would. Because of this, hard tips create less spin and are more liable to slip or miscue when striking the cue ball farther off the center point. However, hard tips will play more consistently, last longer and require less maintenance. Thus, until now, a player has faced a difficult decision in deciding to play a softer versus a harder tipped cue.

Therefore, an improved billiard cue tip would combine the best features of both soft and hard tips, a problem addressed successfully by the instant invention.

SUMMARY OF THE INVENTION

The disclosed invention relates to methods to for making an improved laterally reinforced billiard cue tip. One or more lateral reinforcing layers, internal or external to the tip may be provided to limit lateral expansion of the tip and provide a tip that has the playing characteristics of both hard, and soft, traditional tips.

BRIEF DESCRIPTION OF THE ILLUSTRATIONS

Without limiting the scope of the laterally reinforced billiard cue tip as disclosed herein and referring now to the drawings and figures.

Figure 1:
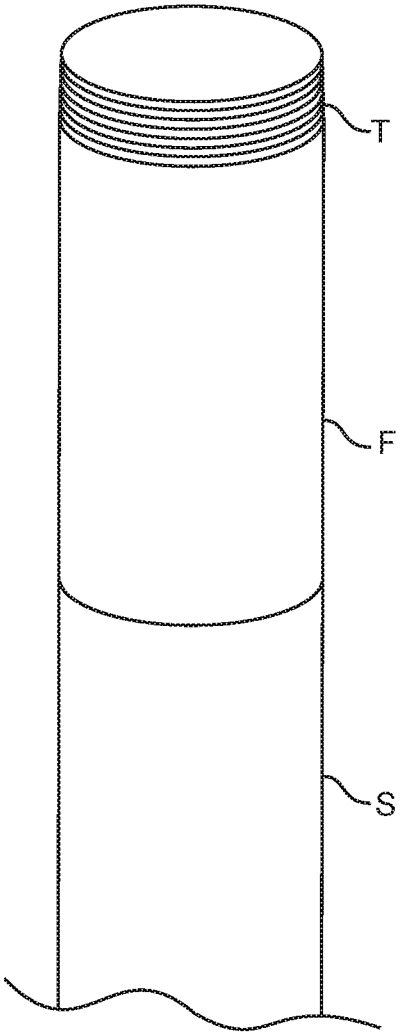
FIG. 1 Prior Art
FIG. 1 is an elevated perspective view of a prior art billiard cue tip.

These illustrations are provided to assist in the understanding of the exemplary embodiments of the method of forming a laterally stabilized billiard cue tip and materials related thereto described in more detail below and should not be construed as unduly limiting the specification. In particular, the relative spacing, positioning, sizing and dimensions of the various elements illustrated in the drawings may not be drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

A typical prior art billiard cue is seen in FIG. 1. A generally wooden shaft (S) has a distal axial end, upon which a billiard cue tip (T) is shown mounted, along with a metal ferrule (F) also seen near the distal axial end of the cue. The tip (T) may be formed of a wide variety of materials, from the relatively soft and resilient, such as leather, to the rigid, such as various phenolic compounds. With leather tips, which are the most common, the tip may be formed of a one-piece cylinder of leather, or, as shown in FIG. 1, the tip may be built up of a plurality of leather layers. For the convenience of the reader, leather tips consistent with the instant invention may be made using either construction, and are sometimes illustrated as being of one-piece design, FIGS. 2, 10, and 11; and sometimes are illustrated as being of the layered variety (remaining Figures). It is to be understood that the present invention is feasible with nearly all manners of tip construction, including both the one-piece and layered types.

Figure 2:
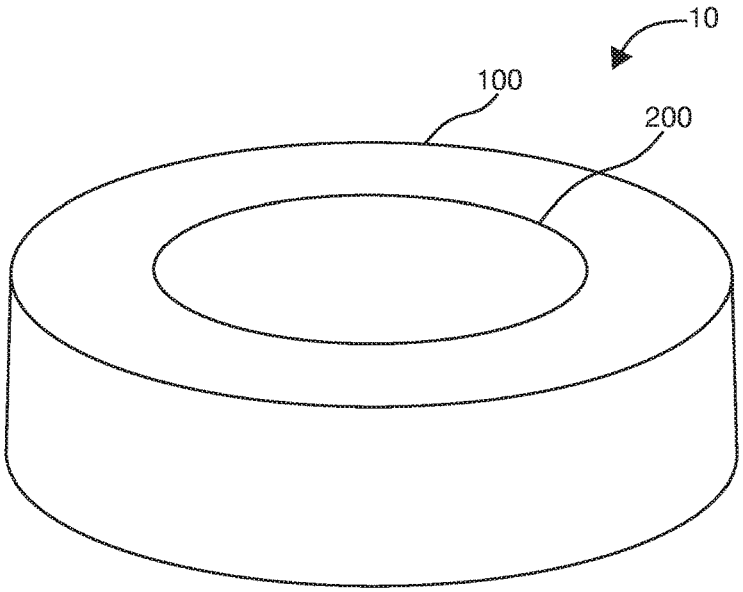
FIG. 2 is an elevated perspective view of a partially constructed billiard cue tip according to an embodiment of the instant invention.
Figure 3:
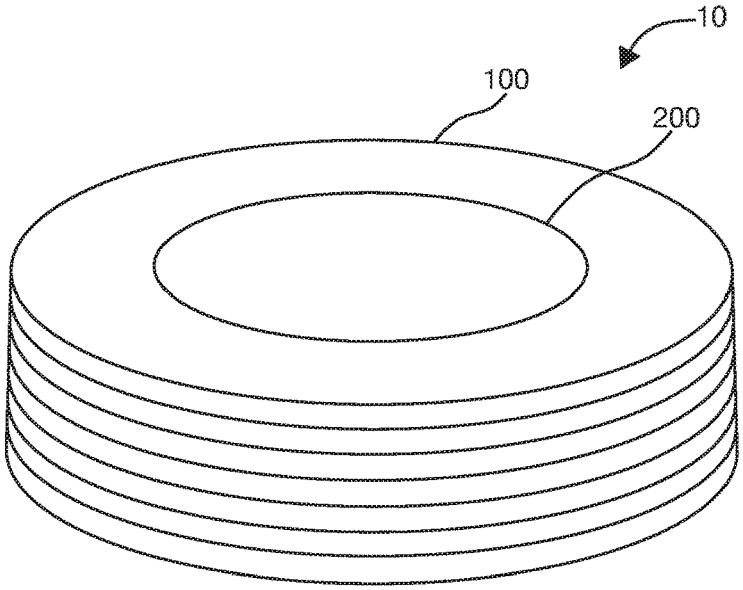
FIG. 3 is an elevated perspective view of a partially constructed billiard cue tip according to another embodiment of the instant invention.
Figure 4:
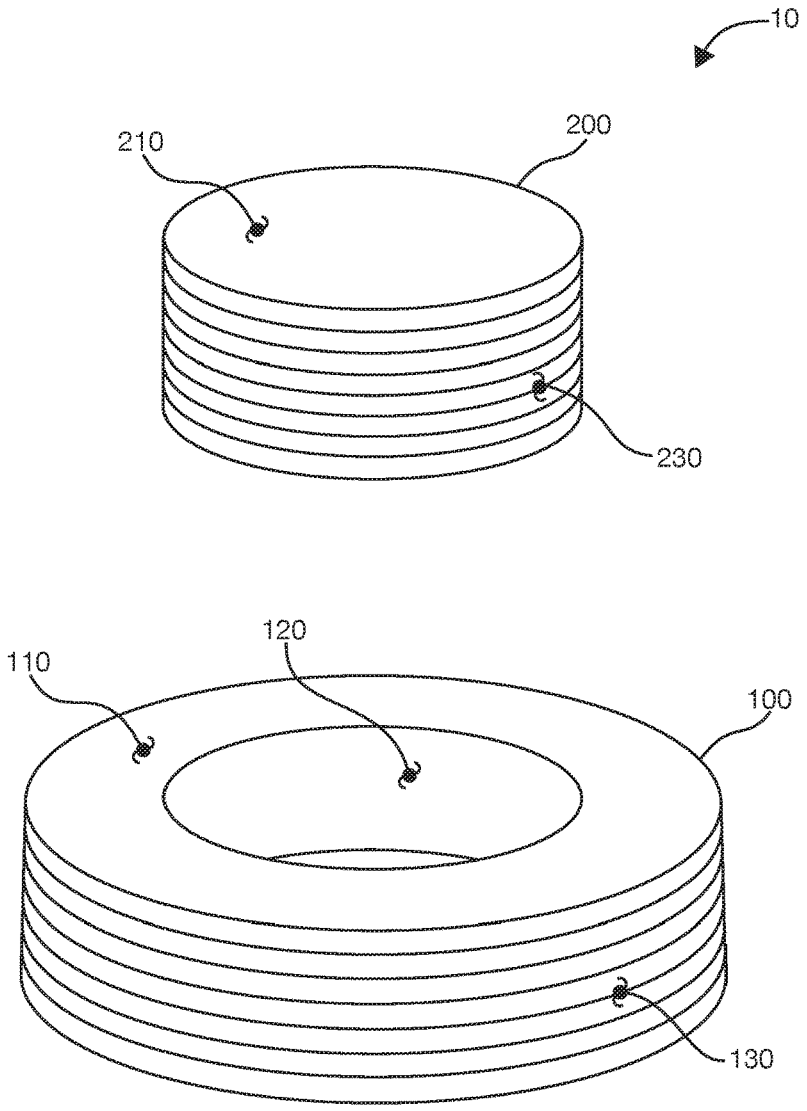
FIG. 4 is an exploded elevated perspective view of a partially constructed billiard cue tip according to an embodiment of the instant invention.
Figure 5:
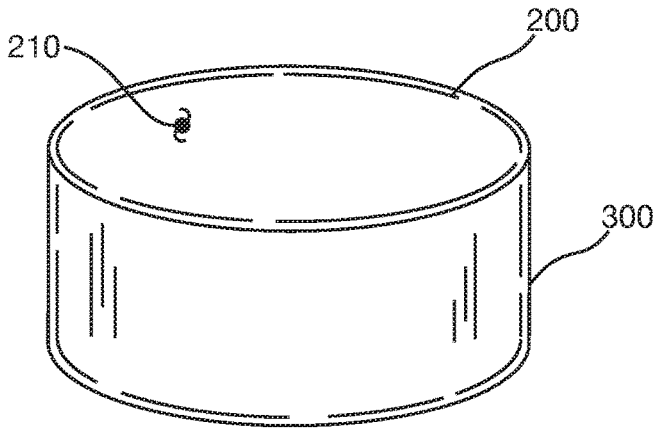
FIG. 5 is an elevated perspective view of part of a partially constructed billiard cue tip according to an embodiment of the instant invention.
Figure 6:
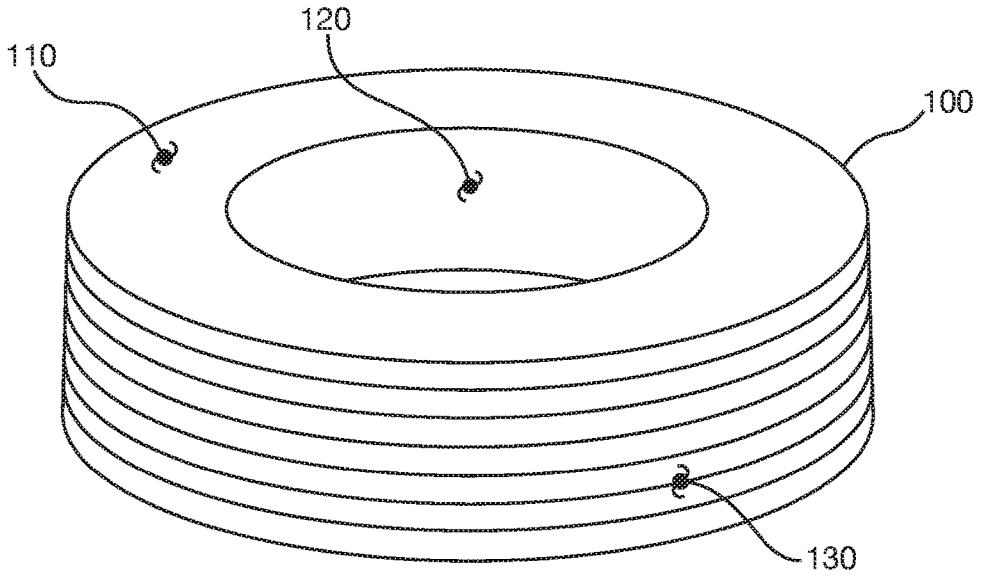
FIG. 6 is an elevated perspective view of part of a partially constructed billiard cue tip according to an embodiment of the instant invention.
Figure 7:
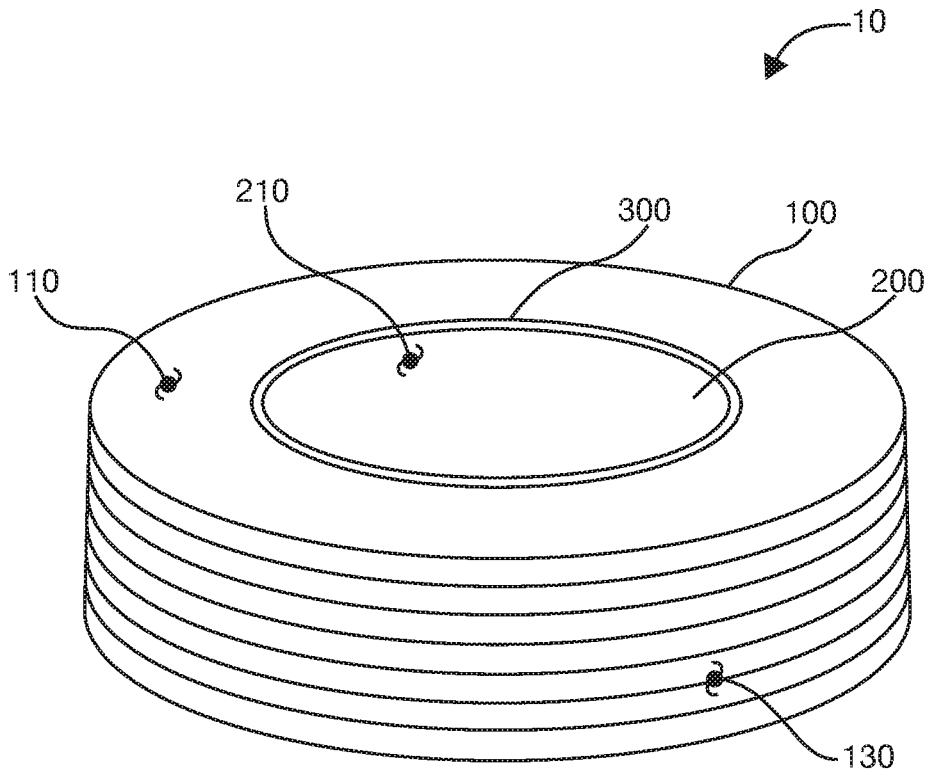
FIG. 7 is an assembled elevated perspective view of the embodiment of FIGS. 5 and 6.

What is claimed then, as seen in FIGS. 2-10, is a laterally reinforced billiard cue tip. Seen in one embodiment well in FIGS. 2-4, the tip (10) may include an outer segment (100) having an outer segment striking surface (110), an outer segment inside circumferential surface (120) and an outer segment outside circumferential surface (130). In FIG. 2 a tip (10) constructed from a single piece of material can be seen in which an inner core (200) has been scribed, ready to cut out, from a larger outer segment. The same stage is represented in FIG. 3, only from a tip that is formed of a plurality of layers, such as would be seen with a built-up, layered, leather tip. A cut inner core (200) is seen in an exploded perspective view, in a layered construction, above an outer segment (100) from which it has been cut. While this is one way of making such inner core (200) and outer segment (100) sections, one skilled in the art would realize that they are not necessarily cut from each other, but could be assembled from parts cut individually. Such an outer segment (100) may then circumferentially surround at least one inner core (200) having an inner core striking surface (210), and an inner core outside circumferential surface (230). The inner core (200) may be retained within the outer segment (100), either by adhesive or by a press-fit joint, or by any other joining method as would be known by one skilled in the art, such as an adhesive, while a lateral reinforcement (300), seen well in FIG. 5, may be applied between the inner core outside circumferential surface (230) and the outer segment inside circumferential surface (120) and in one exploded and then assembled embodiment, may be seen well in FIGS. 6 and 7.

One skilled in the art will realize the alteration the presence of such a lateral reinforcement may make on the performance of the tip (10). When an object ball is struck, the force of the impact is transferred to the tip. Most of the force will be transmitted axially to the shaft of the cue, but do to at least some resilience in the tip (10), especially those tips (10) of leather construction, there will be a lateral force vector transmitted at approximately a 90 degree angle to the axis of the cue, and this force vector will cause some deformation of the tip in a lateral direction. This force is essentially "lost" to the player, as it is not used to propel the object ball, and also increases the risk of poor hits ("miscues") and contributes to the wear and tear upon, and ultimate degradation of, the tip. (10). This lateral force is attenuated in a very hard tip, such as a phenolic tip, but such tips may have undesirable surface characteristics.

Figure 8:
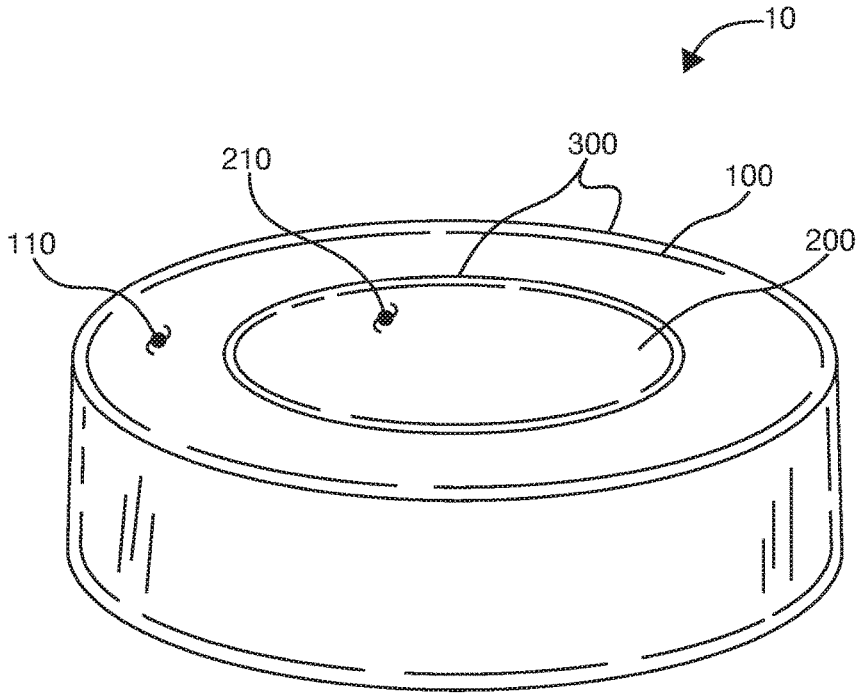
FIG. 8 is an elevated perspective view of an embodiment of a billiard cue tip according to an embodiment of the instant invention.

In yet another embodiment, seen well in FIG. 8, in addition to the lateral reinforcement (300) between the inner core (200) and the outer segment (100), an additional lateral reinforcement layer (300), may be applied on the outer segment outer circumferential surface (130). Such lateral reinforcements (300) may be of the same, or of different, materials.

Again, one skilled in the art will see that the presence of a non-stretching lateral reinforcement (300) will limit the radial expansion of the tip (10) thereby causing the tip (10) to behave in certain ways, i.e., with less lateral expansion, like a single material tip having a much greater hardness. However, because the lateral reinforcement makes up only a tiny portion of the striking surface (110, 210); it has a negligible effect on the surface characteristics of the striking surfaces (110, 210). i.e., a tip that is mostly comprised of soft leather will display the surface characteristics of a traditional soft leather tip. Therefore, the tip (10) of the instant invention combines desirable characteristics of both soft and hard billiard cue tips. By way of example, test show that tips built according to various embodiments of the instant invention, while made of leather having Shore D hardness rating of approximately 66 on a standard Shore D durometer with 1 kilogram pressure, will display surface characteristic of a soft tip, which will play as though made of a much harder material.

As stated before, the tip (10) may be built-up of a plurality of layers of many types of flexible material, including but not limited to leather.

The tip (10) may also comprise a flexible, as well as non-stretching material, and by way of example only, and not limitation, materials may include various aramid fiber, and in one embodiment, be formed of a poly-paraphenylene terephthalamide (KEVLAR™; E.I. Dupont de Nemours and Company, Delaware, U.S.A.)

In another series of embodiments, a laterally stabilized billiard cue tip (10, may have an inner core (200), formed of a flexible material having an outer segment striking surface (110) and an inner core striking surface (210) with an interposed lateral reinforcement (300) between the inner core (200) and the outer segment (100), but also have a flexible non-stretching lateral reinforcement (300) being applied to the outside circumferential surface (130) of the outer segment (100). Such an embodiment, by way of illustration only, may be see in FIG. 8.

As before, in such a series of embodiments, the flexible non-stretching lateral reinforcement (300) may include an aramid fiber, such as, by way of example only, a poly-paraphenylene terephthalamide. (KEVLAR™; E.I. Dupont de Nemours and Company, Delaware, U.S.A.), and each lateral reinforcement (300) may be formed of the same material, or of different materials.

Figure 9:
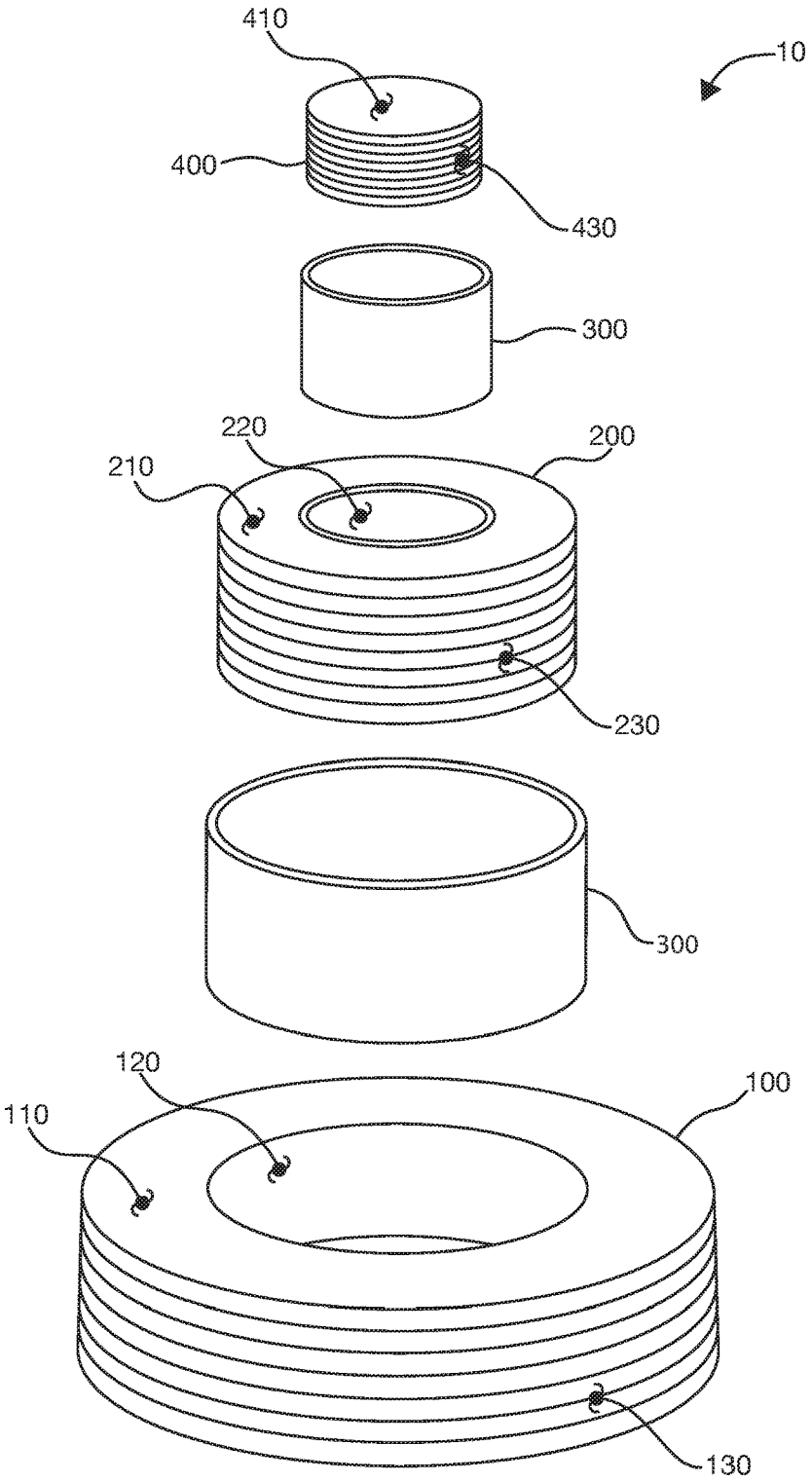
FIG. 9 is an exploded elevated perspective view of an embodiment of a billiard cue tip according to an embodiment of the instant invention.
Figure 10:
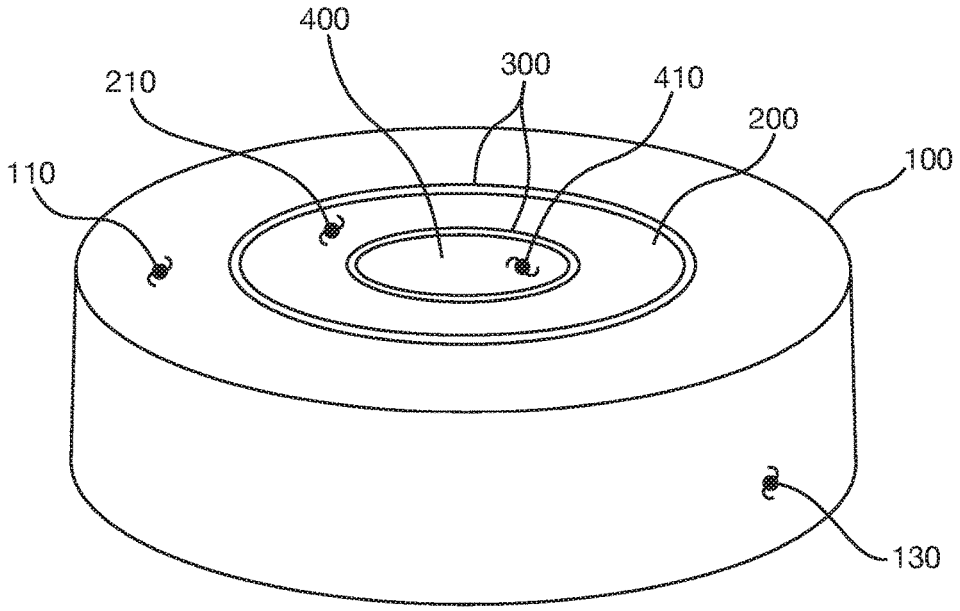
FIG. 10 is an assembled elevated perspective view of the embodiment of FIG. 9.

In yet another series of embodiments, seen well in an exploded view in FIG. 9 and an assembled view in FIG. 10, a laterally stabilized billiard cue tip (10), may have more than a single inner core (200), contained within an outer segment (100). Such construction could include an outer segment (100) having an outer segment striking surface (110), an outer segment inside circumferential surface (120) and an outer segment outside circumferential surface (130). This could then circumferentially surround a first inner core (200) having a first inner core striking surface (210), a first inner core inside circumferential surface (220) and a first inner core outside circumferential surface (230). There could also be a second inner core (400) having a second inner core striking surface (410), and a second inner core outside circumferential surface (430), where the second inner core (400) may be retained within the first inner core (200) and the first inner core (200) is retained within the outer segment (100).

In an exemplary series of embodiments, a second lateral reinforcement (300) may be applied between the second inner core outside circumferential surface (430) and the first inner core inside circumferential surface (220) and a first lateral reinforcement (300) may be applied between the first inner core outside circumferential surface (230) and the outer segment inside circumferential surface (120). In addition, (in an embodiment not shown) yet another lateral reinforcement could be applied to the outer segment outside circumferential surface (130), and all lateral reinforcements (300) could be formed of the same, or of different, materials.

Among may alternatives as would be known to one skilled in the art, at least one of the first and the second lateral reinforcements (300) may be applied to at least one surface consisting of the second inner core outside circumferential surface (430), the first inner core inside circumferential surface (220), the first inner core outside circumferential surface (230) the outer segment inside circumferential surface (120), and the outer segment outside circumferential surface (130) by an adhesive, or again, by any materials joining method as would be known to one skilled in the art. As before, at least one of the first and the second lateral reinforcements (300) may further include a flexible non-stretching material, including but not limited to an aramid fiber, and may even more particularly include a poly-paraphenylene terephthalamide. The same may be said of any lateral reinforcement (300) applied to the outer segment outside circumferential surface (130).

One skilled in the art will also realize that this mode of construction is not limited to an outer segment enclosing two inner cores; but that a plurality of inner cores may be made, each surrounded by a slighter larger diametered one.

Figure 11:
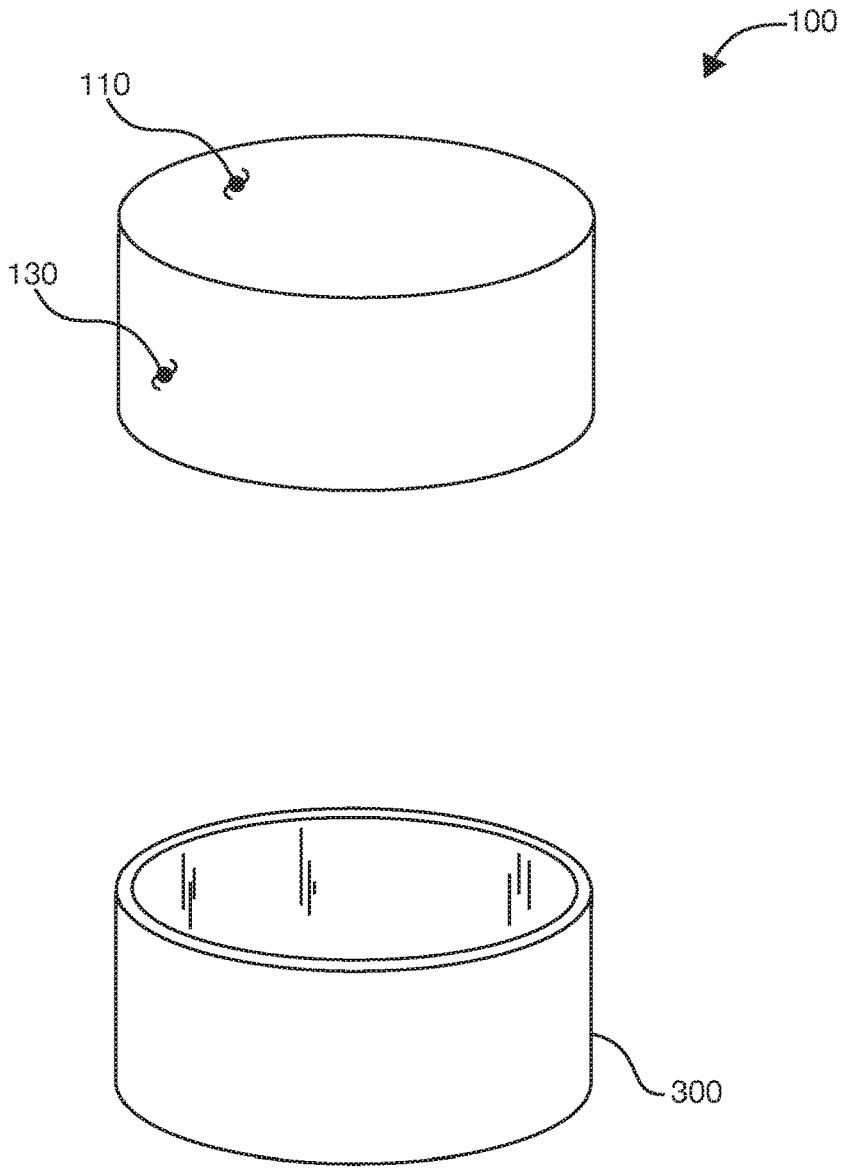
FIG. 11 is an exploded elevated perspective view of a billiard cue tip according to an embodiment of the instant invention.
Figure 12:
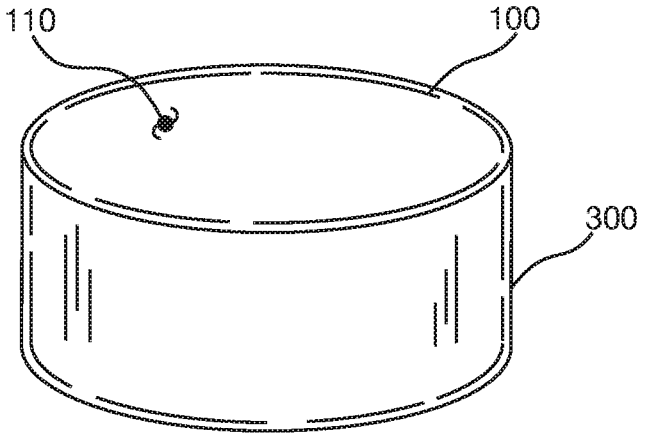
FIG. 12 is an assembled perspective view of the embodiment of FIG. 11.

In another series of embodiments, the tip (10) may have only have a single lateral reinforcement layer (300) applied to the outside of a tip (10) having no inner core (200), and being applied only to the outside of the tip (10), such as seen well in an exploded view in FIG. 11 and an assembled view in FIG. 12.

Numerous alterations, modifications, and variations of the preferred embodiments disclosed herein will be apparent to those skilled in the art and they are all anticipated and contemplated to be within the spirit and scope of the disclosed specification. For example, although specific embodiments have been described in detail, those with skill in the art will understand that the preceding embodiments and variations can be modified to incorporate various types of substitute and or additional or alternative materials, relative arrangement of elements, order of steps and additional steps, and dimensional configurations. Accordingly, even though only few variations of the method and products are described herein, it is to be understood that the practice of such additional modifications and variations and the equivalents thereof, are within the spirit and scope of the method and products as defined in the following claims. The corresponding structures, materials, acts, and equivalents of all means or step plus function elements in the claims below are intended to include any structure, material, or acts for performing the functions in combination with other claimed elements as specifically claimed.

We claim:

1. A laterally stabilized billiard cue tip (10), comprising:

an outer segment (100) having an outer segment striking surface (110), an outer segment inside circumferential surface (120) and an outer segment outside circumferential surface (130) circumferentially surrounding, at least one inner core (200) having an inner core striking surface (210), and an inner core outside circumferential surface (230), wherein, the inner core (200) being retained within the outer segment (100), and a flexible, non-stretching lateral reinforcement (300) is applied between the inner core outside circumferential surface (230) and the outer segment inside circumferential surface (120).

2. The tip (10) according to claim 1, wherein the tip is built-up of a plurality of layers of flexible material.

3. The tip (10) according to claim 1, wherein the tip further comprises an at least partially leather tip.

4. The tip (10) according to claim 1, wherein the lateral reinforcement (300) further comprises an aramid fiber.

5. The tip (10) according to claim 1, wherein the lateral reinforcement (300) further comprises a poly-paraphenylene terephthalamide.

6. The tip (10) according to claim 1, wherein the lateral reinforcement (300) is applied to at least one surface consisting of the inner core outside circumferential surface (230) and the outer segment inside circumferential surface (120) by an adhesive.

7. The tip (10) according to claim 1, wherein the inner core (200) is retained within the outer segment (100) by a press-fit joining.

8. A laterally stabilized billiard cue tip (10, comprising:

a flexible material having a striking surface (110) and an outside circumferential surface (130), wherein a flexible non-stretching aramid fiber lateral reinforcement (300) is applied to the outside circumferential surface (130).

9. The device according to claim 8 wherein the flexible non-stretching lateral reinforcement (300) further comprises a poly-paraphenylene terephthalamide.

10. A laterally stabilized billiard cue tip (10), comprising:

an outer segment (100) having an outer segment striking surface (110), an outer segment inside circumferential surface (120) and an outer segment outside circumferential surface (130) circumferentially surrounding, a first inner core (200) having a first inner core striking surface (210), a first inner core inside circumferential surface (220) and a first inner core outside circumferential surface (230), a second inner core (400) having a second inner core striking surface (410), and a second inner core outside circumferential surface (430), wherein, the second inner core (400) is retained within the first inner core (200) and the first inner core (200) is retained within the outer segment (100), and a second lateral reinforcement (300) is applied between the second inner core outside circumferential surface (430) and the first inner core inside circumferential surface (220) and a first lateral reinforcement (300) is applied between the first inner core outside circumferential surface (230) and the outer segment inside circumferential surface (120).

11. The device according to claim 10, wherein at least one of the first and the second lateral reinforcements (300) is applied to at least one surface consisting of the second inner core outside circumferential surface (430), the first inner core inside circumferential surface (220), the first inner core outside circumferential surface (230) and the outer segment inside circumferential surface (120) by an adhesive.

12. The device according to claim 10 wherein at least one of the first and the second lateral reinforcements (300) further comprises a flexible non-stretching material.

13. The device according to claim 10 wherein at least one of the first and the second lateral reinforcements (300) further comprises an aramid fiber.

14. The device according to claim 10 wherein at least one of the first and the second lateral reinforcements (300) further comprises a poly-paraphenylene terephthalamide.

* * * * *